United States Patent [19]

Winter et al.

[11] 4,176,049

[45] Nov. 27, 1979

[54] CATALYTIC CRACKING PROCESS

[75] Inventors: William E. Winter; William L. Schuette, both of Baton Rouge, La.

[73] Assignee: Exxon Research & Engineering Co., Florham Park, N.J.

[21] Appl. No.: 892,938

[22] Filed: Apr. 3, 1978

[51] Int. Cl.[2] ..... C10G 37/10

[52] U.S. Cl. ..... 208/70; 208/92

[58] Field of Search ..... 208/70, 92

[56] References Cited

U.S. PATENT DOCUMENTS

| | | | |
|---|---|---|---|
| 2,981,674 | 4/1961 | Good | 208/70 |
| 3,692,667 | 9/1972 | McKinney et al. | 208/120 |
| 3,784,463 | 1/1974 | Reynolds et al. | 208/74 |
| 3,950,242 | 4/1976 | Garwood et al. | 208/70 |

*Primary Examiner*—Herbert Levine

*Attorney, Agent, or Firm*—Llewellyn A. Proctor

[57] ABSTRACT

A process which comprises recracking a cracked naphtha feed containing up to about 60 percent, suitably from about 20 to about 40 percent olefins, over a crystalline aluminosilicate zeolite catalyst to further crack the naphtha and saturate at least about 50 percent of the olefins, preferably from about 90 percent to about 100 percent of the olefins, based on the weight of said cracked naphtha feed. In a preferred combination a gas oil is catalytically cracked in a first stage to produce a cat cracked naphtha product of high olefin content, and an intermediate boiling component thereof is recracked as a feed in a second stage over a zeolite catalyst to saturate the olefins, and hydrodenitrogenate and hydrodesulfurize said cat cracked naphtha. The recracked cat cracked naphtha is then hydrotreated at low to mild severities and then catalytically reformed (hydroformed) to produce high octane gasoline.

15 Claims, No Drawings

CATALYTIC CRACKING PROCESS

Many refinery units provide stocks to form the gasoline blending pools which serve as supplies of motor gasoline. For example, stocks of natural or straight run gasoline are produced from virgin feeds by straight distillation. Alkylation units are employed to react low molecular weight olefins and paraffins to provide stocks within the gasoline boiling range. Cracking units are employed to reduce the molecular weight of feeds, and thereby provide stocks boiling in the gasoline range. Both virgin and cracked feeds in the gasoline boiling range, including naphthas, may be subjected to catalytic reforming, or hydroforming, to provide upgraded stocks, particularly stocks of increased octane. With the phaseout of lead anti-knock compounds it continues a formidable challenge for the refiner to maintain gasoline pools at the octane levels demanded; and, the problem is aggravated by the depletion of conventional petroleum supplies which creates an increased need to process heavy feedstocks such as residua, unconventional heavy crudes and the like for conversion to gasoline.

Cracking processes, both thermal and catalytic, have constituted the heart of petroleum refining operations for several decades. The purpose of both types of process is the same, i.e., to break heavy molecular feed components into lower boiling, more valuable components. The thermal process, which has now been largely replaced by the more effective catalytic process, accomplishes this result by heat, whereas the catalytic process breaks the large molecules by contact between a heavy feed and an active catalyst at lower temperatures than used in thermal processes. The reactions which occur in the catalytic cracking operation are complex including, not only carbon-carbon bond scission but isomerization, alkylation, dehydrogenation, etc., and a carbonaceous material, or coke, is inevitably deposited on the catalyst. The catalyst, in such unit, is regenerated in a separate vessel, i.e., a regenerator, by burning off the coke to restore its activity. Commonly, the catalyst is continuously cycled between the reactor and regenerator as a moving bed without shutdown of either unit. Illustrative of commercial catalytic cracking processes are Airlift TCC as developed by Mobil Oil Corporation (Petroleum Refiner, Vol. 31, No. 8, August 1952, pp. 71–78); Fluid Catalytic Cracking as developed by Universal Oil Products Company (Petroleum Refiner, Vol. 30, No. 3, March 1951, pp. 130–136); Fluid Catalytic Cracking as developed by Esso Research and Engineering Company, Exxon Research and Engineering Companys' predecessor (Petroleum Refiner, Vol. 35, No. 4, April 1956, pp. 201–205); Fluid Catalytic Cracking, Orthoflow, as developed by the M. W. Kellogg Company (Hydrocarbon Processing, Vol. 42, No. 5, May 1963, pp. 135–140); and Houdriflow Catalytic Cracking as developed by Houdry Process and Chemical Company, Division of Air Products and Chemicals, Inc.

The economics of the catalytic cracking unit in a refinery because of its high degree of flexibility, to a large extent, determines the product slate which will be produced by a refinery. Products from the catalytic cracking unit thus provide feed for other units, e.g., alkylation and polymerization units. Cat cycle stocks are used to make lubes, and gas is employed as fuel in the refinery.

Cat cracking feed stocks are provided by atmospheric and vacuum stills, phenol extraction plants and hydrotreaters. The usual feed to a commercial catalytic cracking unit is comprised of a gas oil boiling below about 1050° F. (1050° F.−), typically a virgin gas oil boiling between about 600° F. and 1050° F. In addition thermally cracked materials are often used as cat cracking feeds. While various conventional types of processing, e.g., cat naphtha reforming and cat naphtha extraction, might be employed to upgrade cat naphtha octanes and increase the supply of high octange gasoline in the gasoline pool as lead is phased out of gasoline, most are quite expensive; particularly cat naphtha reforming which requires initial hydrotreating of the feed so that it can meet reformer feed specifications.

Hydrogen constitutes a major cost in hydrotreating a cat naphtha such that it can meet reformer feed specifications because such feeds are typically olefinic, and hydrogen is required for saturation of the olefins. The intermediate fractions obtained from cat naphthas produced at high severities, albeit the heavier fraction may be of low olefinic content and of relatively high octane, are highly olefinic, e.g., typically 20 to 40 percent, and higher; perhaps 60 percent, and higher. The olefins must be virtually completely saturated before the cat naphthas can be reformed over a platinum or promoted platinum catalyst, this requiring generally from about 200 to 400 SCF/B of hydrogen to saturate the olefins typically contained in an intermediate boiling range cat naphtha. Moreover, in addition to the restrictive olefins specifications imposed on a cat naphtha feed, such feeds also contains considerable amounts of sulfur and nitrogen, and far more severe hydrotreating of the cat naphtha to bring it in line with sulfur and nitrogen reformer feed specifications is required than even is necessary in hydrotreating virgin naphtha. In fact, in cat naphtha hydrofining mercaptan reversion reactions, or reactions wherein the hydrogen sulfide by product reacts with cat naphtha olefins to form mercaptans is a troublesome problem; for mercaptans cannot be tolerated in significant amounts within the feed. Mercaptans must thus be eliminated by hydrofining, or hydrotreating the cat naphtha at severe conditions.

It is, accordingly, the primary objective of the present invention to provide an improved process which will at least in part overcome these and other disadvantages of present catalytic cracking processes, and in fact provide a new and novel multiple stage catalytic cracking process for the cracking of gas oils.

A specific object is to provide a new and novel process for the operation of catalytic cracking units, notably one which desulfurizes and improves the octane number of cracked naphthas obtained by the catalytic cracking of a gas oil.

These objects and others are achieved in accordance with the present invention embodying a process, an essential feature of which comprises recracking a cracked naphtha feed containing up to about 60 percent, suitably from about 20 to about 40 percent olefins, over a crystalline aluminosilicate zeolite catalyst to further crack the naphtha and saturate at least about 50 percent of the olefins, preferably from about 80 percent to about 100 percent of the olefins, based on the weight of said cracked naphtha feed. Suitably, the cracked naphtha feed is contacted and reacted over the catalyst, without dilution of said feed, at temperature ranging from about 800° F. to about 1100° F., preferably from about 900° F. to about 1030° F., and at pressure ranging from about 0 to about 50 pounds per square inch gauge (psig), preferably from about 5 psig to about 20 psig, reaction at such conditions not only producing significant saturation of the olefins, but also significant hydrodenitrogenation and hydrodesulfurization of said cat naphtha feed.

In its preferred aspects the process is one wherein a conventional sulfur-bearing cat cracker feed, suitably a gas oil, is catalytically cracked, at conventional conditions, in an initial or first stage to provide a cat naphtha product containing generally from about 10 to about 60 percent, preferably from about 20 to about 40 percent olefins. The cat naphtha product in whole or in part is then recracked, as an undiluted feed, in a subsequent or second catalytic cracking zone over a crystalline aluminosilicate zeolite catalyst. Preferably, the cat naphtha product of the initial or first stage is split into fractions inclusive of a low octane, highly olefinic intermediate fraction having a low end boiling point ranging from about 120° F. to about 250° F., preferably from about 180° F. to about 220° F., and a high end boiling point ranging from about 250° F. to about 380° F., preferably from about 270° F. to about 350° F. The higher boiling fraction, or fraction typically having a low end boiling point ranging from about 250° F. to about 380° F. and a high end boiling point ranging from about 350° F. to about 450° F. is normally not recracked because it is generally of relatively high octane and upgrading of this fraction is not required. The intermediate fraction per se, preferably, is utilized as a feed and further catalytically cracked, or recracked, in a subsequent stage over a crystalline aluminosilicate zeolite catalyst sufficient to produce significant saturation of the olefins, and hydrodenitrogenation and hydrodesulfurization of said cat cracked naphtha fraction. The recracked product thereof, is then hydrotreated, or hydrofined, at mild hydrotreating conditions, and then reformed over a conventional catalyst at conventional reforming (hydroforming) conditions to provide a low olefin gasoline of improved octane.

It has been found, quite surprisingly, that the recracking of an undiluted cracked naphtha, notably the intermediate boiling fraction, over a zeolite catalyst at rather low or mild conditions significantly increases the octane number and reduces the olefin content of the cracked naphtha by saturation of the olefins, without direct hydrogen addition. This not only virtually eliminates any necessity of hydrotreating the cracked naphtha to reduce its olefin content, but also significantly reduces the nitrogen and sulfur content of the cracked naphtha. In particular, it has been found that recracking reduces the sulfur content of the feed by up to about 75 percent, or higher, based on the weight of sulfur in the cat cracked naphtha. Thereafter, only a mild hydrotreatment of the cat cracked naphtha product is required to eliminate residual sulfur and thereby render the product susceptable to reforming over highly sulfur sensitive catalysts to further improve the octane number. This, of course, significantly reduces the capital cost of the required hydrotreater (or hydrofiner) and direct high costs of hydrotreating a cracked naphtha to reforming feed specifications. Furthermore, recracking of the cracked naphtha in this manner prior to hydrotreatment of the cracked naphtha to eliminate olefins minimizes mercaptan reversion reactions wherein olefins normally react with by product hydrogen sulfide to form mercaptans, any significant amount of which simply cannot be tolerated in a reformer feed.

Various cracking catalysts can be used in cracking the gas oil feed, or feed to the first stage catalytic cracker. Suitable cracking catalysts include conventional silica-based materials. Exemplary of such catalysts are, e.g., amorphous silica-alumina; silica-magnesia; silica-zirconia; conventional clay cracking catalysts, and the like. The amorphous gel silica-metal oxide cracking catalyst may further be composited with kaolin in amounts of about 10 to 40 wt. % (based on total weight of the composited catalyst) and up to 20 wt. % or more crystalline aluminosilicate zeolite, such as faujasite. A crystalline aluminosilicate zeolite catalyst is required in the second stage catalytic cracker, i.e., for cracking the cat cracked naphtha, or fraction thereof, from the first stage. These catalysts are well known and commercially available. Preferably, the catalyst utilized, particularly in the second stage catalytic cracker is an amorphous silica-alumina catalyst containing from about 5 to 16 weight percent y-type faujasite, and, optionally 15 to 40 percent kaolin.

Generally, the first and second stage catalytic crackers are operated at about the same absolute conditions of temperature, pressure, space velocity, and catalyst/oil ratio, the runs being initiated by adjusting the feed and catalyst rates, and the temperature and pressure of the reactor to operating conditions. The catalytic cracking operation in both stages of cracking is continued at conditions by adjustment of the major process variables, within the ranges described below:

| Major Operating Variables | Typical Process Conditions | Preferred Process Conditions |
|---|---|---|
| Pressure, Psig | 0–50 | 5–20 |
| Reactor Temp., °F. | 800–1100 | 900–1030 |
| Space Velocity, W/W/Hr | 2–200 | 5–150 |
| Catalyst/Oil Ratio, (Instantaneous Vol. of Reactor Space) lbs./per lb. of oil | 2–12 | 4–8 |

The product of the first stage catalytic cracker, suitably a cat cracked naphtha obtained by cracking a gas oil, is characterized as a cracked naphtha having an olefin content ranging from about 10 percent to about 60 percent, more typically from about 20 percent to about 40 percent (by weight) and boiling within the gasoline range, typically from about 65° F. to about 430° F. (i.e., $C_5$/430° F.). A portion of the cat cracked naphtha, preferably an intermediate fraction, as previously defined, is split from the product of said first stage, fed into, and recracked, without dilution, over the crystalline aluminosilicate zeolite catalyst in the second stage catalytic cracker. The recracked product is then subjected to a mild hydrotreatment by contact, with a catalyst comprising a composite of an inorganic oxide base, suitably alumina, and a Group VI-B or Group VIII metal, or both, e.g., a cobalt moly/alumina catalyst, at conditions given as follows, to wit:

| Process Variable | Typical Process Conditions | Preferred Process Conditions |
|---|---|---|
| Pressure, psig | 100–2000 | 200–300 |
| Temperature, °F. | 400–800 | 500–600 |
| Feed Rate, LHSV | 1–25 | 2–6 |
| Hydrogen Rate, SCF/Bbl | 200–3000 | 200–500 |

The product from the hydrofiner is subjected to reforming, at reforming conditions, by contact with a sulfur-sensitive, noble metal reforming catalyst to produce a satisfactory high octane gasoline. Suitably, the reforming run is initiated by injection of hydrogen into the reforming reactor (or zone) with the feed at the desired hydrogen and feed rates, with adjustment of the temperature and pressure to operating conditions. The run is continued at optimum reforming conditions by adjustment of the major process variables, within the ranges described below:

| Major Operating Variables | Typical Process Conditions | Preferred Process Conditions |
|---|---|---|
| Pressure, Psig | 50-750 | 100-300 |
| Reactor Temp., °F. | 750-1100 | 850-1000 |
| Gas Rate, SCF/B (Incl. Recycle Gas) | 1500-10,000 | 2000-7000 |
| Feed Rate, W/W/Hr | 0.5-10 | 1-3 |

The catalyst employed is one comprising a refractory or inorganic oxide support material, particularly alumina, which is composited with a Group VIII noble metal hydrogenation-dehydrogenation component, notably platinum, to which may be added an additional metal, or metals, to promote the activity and selectivity of the catalysts, particularly iridium or rhenium, or both, or component selected from the Group IV metals, Group VI metals, Group VII metals, and Group VIII metals, e.g., germanium, tin, lead, osmium, ruthenium, rhodium or the like. A halogen component, suitably chlorine, is generally added to provide the desired acidity. These components can be added to a support by any of the conventional methods, e.g., by impregnation prior to, following or simultaneously with the impregnation of the noble metal, or halogen components. The metal hydrogenation-dehydrogenation components, or promotors are added to a support in concentration ranging about 0.01 to 3 percent, preferably from about 0.05 to about 1 percent, based on the weight of the catalyst. A suitable support can contain, e.g., one or more of alumina, bentonite, clay, diatomaceous earth, zeolite, silica, activated carbon, magnesia, zirconia, thoria, and the like; though the most preferred support is alumina to which, if desired, can be added a suitable amount of other refractory carrier materials such as silica, zirconia, magnesia, titania, etc., usually in a range of about 1 to 20 percent, based on the weight of the support. A preferred support is one having a surface area of more than 50 $m^2/g$, preferably from about 100 to about 300 $m^2/g$, a bulk density of about 0.3 to 1.0 g/ml, preferably about 0.4 to 0.8 g/ml, an average pore volume of about 0.2 to 1.1 ml/g, preferably about 0.3 to 0.8 ml/g, and an average pore diameter of about 30 to 300 Å.

The invention will be more fully understood by reference to the following nonlimiting demonstrations and examples which, though in part simulated, present comparative data which illustrate its more salient features. All parts are given in terms of weight unless otherwise specified.

In a first step, a 155° F./413° F. cat naphtha fraction was obtained by catalytically cracking a virgin gas oil at conventional conditions over a conventional catalyst to obtain a cat cracked naphtha, hereinafter referred to as Feedstock A, the complete feedstock inspections of which are given in Table I, below.

Table 1

| Feedstock A | |
|---|---|
| 155° F./413° F. Cat Naphtha | |
| Sulfur, wppm | 572 |
| Nitrogen, wppm | 30 |
| Br. No., cc/gm | 24.8 |
| Octane | |
| RONC | 82.8 |
| MONC | 75.2 |
| FIA, Vol. % | |
| Arom. | 33.6 |
| Olefins | 15.3 |
| Saturates | 51.0 |
| ASTM D-86 | |
| IBP/5% | 155/194 |
| 10/20 | 207/228 |
| 30/40 | 245/262 |
| 50/60 | 280/300 |
| 70/80 | 320/337 |
| 90/95 | 365/383 |
| FBP | 413 |

EXAMPLE 1

Feedstock A was recracked in a reactor at 930° F., 14.7 psia, 13.7 WHSV and at a catalyst/oil ratio of 9.2 over a conventional commercial zeolite cracking catalyst containing crystalline aluminosilicate zeolite, silica alumina gel and clays, and the product then fractionated to provide three fractions, i.e., a low boiling 65°/200° F. fraction, an intermediate 200°/350° F. fraction and a high boiling 350°/430° F. fraction, as characterized in Table II.

Table II

| | 65/200° F. | 200/350° F. | 350/430° F. |
|---|---|---|---|
| Vol. % on Feed | 21.6 | 48.6 | 9.7 |
| Sulfur, wppm | 42 | 91 | 893 |
| Nitrogen, wppm | 2 | 2 | 9.2 |
| Br. No. cc/gm | 20.3 | 3.3 | 1.41 |
| Octane | | | |
| RONC. | 85.1 | 89.7 | 93.8 |
| MONC | 80.0 | 80.5 | 82.9 |
| FIA, Vol. % | | | |
| Arom. | 3.8 | 50 | 74.7 |
| Olefins | 11.6 | 0.6 | 0.1 |
| Saturates | 84.6 | 49.4 | 25.1 |

The 200°/350° F. fraction is then hydrofined over a cobalt moly-on-alumina catalyst at conditions just sufficient to produce a suitable reforming feed, this requiring 98.9% hydrodesulfurization, 50% hydrodenitrogenation, and 70% saturation of the olefins to provide a product of 89 RONC with less than 1 ppm sulfur, less than 1 ppm nitrogen and a bromine number of less than 1. In forming this product a hydrogen consumption of 20 SCF/Bbl is required.

The hydrofined fraction is then reformed over an iridium promoted platinum catalyst at 930° F., 1.0 W/Hr/W, 200 psig at a hydrogen rate of 4800 SCF/Bbl to produce 100 RONC gasoline.

In sharp contrast, when Feedstock A was split into fractions without recracking, the compositions given in Table III were obtained, to wit:

Table III

| | 65/200° F. | 200/350° F. | 350/430° F. |
|---|---|---|---|
| Vol. % on Feed | 17.2 | 61.9 | 18.9 |
| Sulfur, wppm | 100 | 226 | 1084.8 |
| Nitrogen, wppm | 1.2 | 17.0 | 62.0 |
| Br. No. cc/gm | 54.6 | 24.6 | 7.8 |

Table III-continued

| | 65/200° F. | 200/350° F. | 350/430° F. |
|---|---|---|---|
| Octane | | | |
| RONC | 87.5 | 81.6 | 82.0 |
| MONC | 79.2 | 75.3 | 75.1 |
| FIA, Vol. % | | | |
| Arom. | 4.7 | 39.4 | 59.2 |
| Olefins | 33.1 | 8.4 | 5.7 |
| Saturates | 62.2 | 52.2 | 35.1 |

These fractions are thus highly unsaturated as contrasted with similar fractions obtained by recracking Feedstock A, and contain considerably more sulfur and nitrogen. By way of further contrast, however, a portion of the 200°/350° F. fraction (Table III) is then hydrofined over the hydrofining catalyst previously defined at conditions just sufficient to achieve 99.6% hydrodesulfurization, 94.1% hydrodenitrogenation and 96% saturation of the olefins to produce a product suitable for reforming to 100 RONC, i.e., one which contained less than 1 ppm sulfur, less than 1 ppm nitrogen and a bromine number of less than 1. This produced a product of 75 RONC and required over 150 SCF/Bbl of hydrogen, well over seven times the amount of hydrogen required to hydrofine the recracked product.

The recracking of Feedstock A is thus shown to drastically reduce the amount of hydrotreating required to produce a reformer feed, and it achieves this at far less severity and with far less consumption of hydrogen. Moreover, assuming first order desulfurization kinetics, 20% less reactor volume is required to achieve 98.9% hydrodesulfurization for the intermediate fraction of recracked Feedstock A than is required to produce 99.6% hydrodesulfurization for the intermediate fraction of raw Feedstock A. It also reduces reforming severity, or the severity required to produce 100 RONC gasoline.

The following example demonstrates a more preferred embodiment wherein an intermediate fraction only is recracked.

EXAMPLE 2

Another portion of the 200°/350° F. fraction split from Feedstock A, as characterized in Table III, was recracked at 930° F., 14.7 psig, 14.3 WHSV and at a catalyst/oil ratio of 9.1. The product was then split into three fractions, a 65°/200° F. fraction, a 200°/350° F. fraction, and a 350°/430° F. fraction as defined in Table IV.

Table IV

| | 65/200° F. | 200/350° F. | 350/430° F. |
|---|---|---|---|
| Vol. % on Feed | 17.3 | 60.8 | 2.7 |
| Sulfur, wppm | 67 | 83 | 186 |
| Nitrogen, wppm | 1.0 | 3.0 | 17 |
| Br. No. cc/gm | 20.4 | 2.7 | 3.5 |
| Octane | | | |
| RONC | 87.4 | 89.6 | — |
| MONC | — | 80.2 | — |
| FIA, Vol. % | | | |
| Arom. | 0 | 45.4 | 97.5 |
| Olefins | 10.2 | 2.6 | 1.0 |
| Saturates | 89.8 | 52.1 | 1.5 |

The 200°/350° F. fraction is then hydrofined over a cobalt moly-on-alumina catalyst at conditions just sufficient to produce a suitable reforming feed, this requiring 98.8% hydrodesulfurization, 67% hydrodenitrogenation, and 63% saturation of the olefins to provide a product of 89.6 RONC with less than 1 ppm sulfur, less than 1 ppm nitrogen and a bromine number of less than one. In forming this product a hydrogen consumption of 20 to 30 SCF/Bbl is required.

The hydrofined fraction is then reformed over an iridium promoted platinum catalyst at 930° F., 1.0 W/Hr/W, 200 psig at a hydrogen rate of 4800 SCB/Bbl to produce 100 RONC gasoline.

These data thus show that recracking the intermediate fraction of a cat naphtha offers definite advantages over recracking the whole cat cracked naphtha. In comparing Example 2 with Example 1 it is thus shown that 85.6 percent of a $C_5$/430° F. product is obtained in recracking an intermediate fraction vis-a-vis the 79.9 percent of $C_5$/430° F. product obtained in recracking the whole of Feedstock A. Moreover, 60.8 percent of a 200°/350° F. product is obtained in recracking the intermediate fraction vis-a-vis the 48.6 percent of a 200°/350° F. product obtained in recracking the whole of Feedstock A. This fraction is particularly suitable as a reformer feed.

The preferred embodiment, as represented by Example 2, also provides higher selectivity for other relatively high value products vis-a-vis the embodiment of Example 1; or, conversely, lower selectivity for products of lesser value vis-a-vis the embodiment of Example 1. The data given in Table V presents comparative data illustrative of the product of such relatively low value by-products as coke, light gases, inclusive of hydrogen and $C_1$ and $C_2$ hydrocarbons, and 430° F.+ hydrocarbons, in the preceding runs wherein, as in Example 1, the whole of Feedstock A is recracked, and in Example 2 an intermediate boiling feedstock is recracked. The Table also presents the yields of $C_3$ and $C_4$ hydrocarbons which were obtained, these products being nearly as valuable as gasoline. The first column of Table V identifies the by-product, the second column gives the percent yield of the by product, based on the amount of recracked feed which was treated, and the third column gives the percent yield, based on the amount of original Feedstock A.

Table V

| | Yield, Based on Recracked Feed | | Yield Based on Feedstock A | |
|---|---|---|---|---|
| Product | Example 1 | Example 2 | Example 1 | Example 2 |
| Coke, Wt. % | 1.31 | 0.86 | 1.31 | 0.53 |
| Hydrogen, Wt. % | 0.0073 | 0.0067 | 0.0073 | 0.0041 |
| $C_1$, Wt. % | 0.13 | 0.10 | 0.13 | 0.062 |
| $C_2$, Wt. % | 0.70 | 0.53 | 0.70 | 0.33 |
| $C_3$, Wt. % | 5.10 | 4.87 | 5.1 | 3.01 |
| $C_4$, Vol. % | 11.00 | 13.4 | 11.0 | 8.3 |
| 430° F.+, Vol. % | 3.5 | 1.9 | 3.5 | 1.2 |

The advantages of recracking an intermediate cut vis-a-vis a whole feed are apparent. In considering these data it is noted in particular that the 430° F.+ product is of low API gravity, is not desirable for use as heating oil, and is unsuitable four use as diesel fuel or jet fuel. Only small levels of this 430+ product can be tolerated in gasoline for it contains multi-ring aromatics which cause serious engine deposits.

Table VI presents data which illustrates that the preferred embodiment produces higher yields of the $C_3$= and $C_4$= hydrocarbons, which material is a potentially valuable alkylate feed. Analysis of to the $C_3$ and $C_4$ hydrocarbons thus shows the following yield of $C_3$= and $C_4^=$ (and i-$C_4$) hydrocarbons, based on recracked feed.

Table VI

| Product | Yield, Based on Recracked Feed | |
|---|---|---|
| | Example 1 | Example 2 |
| $C_3^=$, Wt. % | 3.90 | 3.6 |
| $C_4^=$, Vol. % | 3.61 | 4.54 |
| i-$C_4$, Vol. % | 6.21 | 7.24 |

The advantages of recracking an intermediate boiling feed are therefore demonstrated. However, the recracking of a heavier fraction, e.g., a 200°/430° F. fraction, is preferable to recracking a whole fraction, i.e., the 65°/430° F. fraction for obviously, inter alia, the cracking of a 65°/200° F. fraction will produce little 200°/350° F. product for reforming, if any.

It is apparent that various modifications and changes can be made without departing the spirit and scope of the invention.

Having described the invention, what is claimed is:

1. A process for the production of a high octane gasoline comprising cracking a sulfur-bearing hydrocarbon feed in a first cracking zone over a cracking catalyst at conditions sufficient to obtain a cat cracked naphtha product containing from about 10 percent to about 60 percent olefins, based on the weight of said product, withdrawing said cat cracked naphtha as a product from said first cracking zone, splitting said product into components inclusive of a fraction having a low end boiling point ranging from about 150° F. to about 250° F. and a high end boiling point ranging from about 350° F. to about 450° F., recracking said cat cracked naphtha fraction, without dilution with other hydrocarbons, over a crystalline aluminosilicate zeolite catalyst in a second cracking zone to desulfurize said feed, and saturate at least about 50 percent of said olefins, based on the weight of said cat cracked naphtha, hydrofining the product of said second cracking zone over a hydrogenation catalyst at hydrofining conditions in a hydrofining zone sufficient to form a feed suitable for reforming over a sulfur-sensitive noble metal reforming catalyst, and then reforming said hydrofined, recracked fraction over a sulfur sensitive noble metal reforming catalyst at reforming conditions to form a high octane gasoline.

2. The process of claim 1 wherein the sulfur-bearing hydrocarbon feed introduced into said first cracking zone is a gas oil boiling below about 1050° F.

3. The process of claim 2 wherein the gas oil boils within a range of from about 600° F. to about 1050° F.

4. The process of claim 1 wherein the cat cracked naphtha product of said first cracking zone contains from about 20 percent to about 40 percent olefins.

5. The process of claim 1 wherein from about 80 to about 100 percent of the olefins of the cat cracked naphtha feed introduced into the second cracking zone is saturated during the reaction.

6. The process of claim 1 wherein the cat cracked naphtha feed introduced into the second cracking zone is reacted at temperature ranging from about 800° F. to about 1100° F. and at a pressure ranging from about 0 to about 50 psig.

7. The process of claim 1 wherein the cat cracked naphtha feed introduced into the second cracking zone is reacted at a temperature ranging from about 900° F. to about 1030° F. and at a pressure ranging from about 5 psig to about 20 psig.

8. The process of claim 1 wherein the cat cracked naphtha obtained as a product from said first cracking zone is split into components inclusive of a fraction having a low end boiling point ranging from about 180° F. to about 220° F. and a high end boiling point ranging from about 400° F. to about 430° F., and said fraction is recracked in the second cracking zone by contact thereof with said crystalline aluminosilicate zeolite catalyst.

9. The process of claim 1 wherein the cat cracked naphtha obtained as a product from said first cracking zone is split into components inclusive of an intermediate fraction having a low end boiling point ranging from about 150° F. to about 250° F. and a high end boiling point ranging from about 250° F. to about 380° F., and said intermediate fraction is recracked in the second cracking zone by contact thereof with said crystalline aluminosilicate zeolite catalyst.

10. A process for the production of a high octane gasoline comprising cracking a sulfur-bearing hydrocarbon feed in a first cracking zone over a cracking catalyst at conditions sufficient to obtain a cat cracked naphtha product containing from about 10 percent to about 60 percent olefins, based on the weight of said product, withdrawing said cat cracked naphtha as a product from said first cracking zone, splitting said product into components inclusive of a fraction having a low end boiling point ranging from about 180° F. to about 220° F. and a high end boiling point ranging from about 400° F. to about 430° F., recracking said cat cracked naphtha product, without dilution with other hydrocarbon feed, over a crystalline aluminosilicate zeolite catalyst in a second cracking zone to desulfurize said feed, and saturate from about 80 percent to about 100 percent of said olefins, based on the weight of said cat cracked naphtha, hydrofining the product of said second cracking zone over a hydrogenation catalyst at hydrofining conditions in a hydrofining zone to hydrodesulfurize said product, and saturate sufficient of the olefins to form a product suitable as a reforming feed, and then reforming the product of said hydrofined zone at reforming conditions over a sulfur sensitive noble metal reforming catalyst to boost the octane of said hydrofined product and form said high octane gasoline.

11. The process of claim 10 wherein the sulfur-bearing hydrocarbon feed introduced into said first cracking zone is a gas oil boiling below about 1050° F.

12. The process of claim 11 wherein the gas oil boils within a range of from about 600° F. to about 1050° F.

13. The process of claim 10 wherein the cat cracked naphtha product of said first cracking zone contains from about 20 percent to about 40 percent olefins.

14. The process of claim 10 wherein the cat cracked naphtha feed introduced into the second cracking zone is reacted at a temperature ranging from about 800° F. to about 1100° F. and at a pressure ranging from about 0 to about 50 psig.

15. The process of claim 11 wherein the cat cracked naphtha feed introduced into the second cracking zone is reacted at temperature ranging from about 900° F. to about 1030° F. and at a pressure ranging from about 5 psig to about 20 psig.

* * * * *